US010364711B1

(12) United States Patent
Riley

(10) Patent No.: US 10,364,711 B1
(45) Date of Patent: Jul. 30, 2019

(54) APPARATUS AND METHOD FOR DYNAMIC HYDRAULIC LOCKING AND RELEASING A CAM LOBE FROM A CAMSHAFT

(71) Applicant: Yelir, Inc., Fort Collins, CO (US)

(72) Inventor: Michael B. Riley, Fort Collins, CO (US)

(73) Assignee: Yelir, Inc., Fort Collins, CO (US)

( * ) Notice: Subject to any disclaimer, the term of this patent is extended or adjusted under 35 U.S.C. 154(b) by 1 day.

(21) Appl. No.: 15/874,738

(22) Filed: Jan. 18, 2018

(51) Int. Cl.
*F01L 1/344* (2006.01)
*F01L 13/00* (2006.01)
*F01L 1/047* (2006.01)

(52) U.S. Cl.
CPC ..... *F01L 13/0005* (2013.01); *F01L 1/047* (2013.01); *F01L 2001/0473* (2013.01)

(58) Field of Classification Search
CPC ..... F01L 1/047; F01L 1/34413; F01L 1/46; F01L 13/0005
USPC ..... 123/90.17, 90.6
See application file for complete search history.

(56) References Cited

U.S. PATENT DOCUMENTS 6,427,653 B1 * 8/2002 Hara ..... F01L 1/047 123/90.17
8,726,861 B2 * 5/2014 Choi ..... F01L 1/143 123/90.16
2009/0183700 A1 * 7/2009 Evans ..... F01L 1/053 123/90.11

* cited by examiner

*Primary Examiner* — Jorge L Leon, Jr.
(74) *Attorney, Agent, or Firm* — Regan L. Trumper; William W. Cochran; Cochran Freund & Young, LLC

(57) ABSTRACT

Poppet valves in an internal combustion engine may be operated intermittently if desired by the selective dynamic locking or unlocking of one or more cam lobes with the shaft that acts as a conventional camshaft when the lobes are locked to it. One or more cam lobes with a small radial clearance ride on a shaft so that an engagement mechanism may be activated as needed to lock the cam lobe to the shaft, thus activating the respective poppet valve. The cam lobe is prevented from moving axially to ensure correct alignment with a follower. A suitable holding device may be used to ensure the non-activated cam lobe(s) is (are) restrained at a suitable orientation relative to the cam follower.

5 Claims, 14 Drawing Sheets

Actuated Pin System for Dynamic Cam Lobe Fixturing – Assembled View

Actuated Pin System for Dynamic Cam Lobe Fixturing – Assembled View

Actuated Pin System for Dynamic Cam Lobe Fixturing – Exploded View

Actuated Pin System 1 for Dynamic Cam Lobe Fixturing – Cross-Section Engaged

Actuated Pin System 1 for Dynamic Cam Lobe Fixturing – Cross-Section Disengaged

Actuated Pin System 2 for Dynamic Cam Lobe Fixturing – Assembled View

Actuated Pin System 2 for Dynamic Cam Lobe Fixturing – Exploded View

Actuated Pin System 2 for Dynamic Cam Lobe Fixturing – Cross-Section Engaged

Actuated Pin System 2 for Dynamic Cam Lobe Fixturing – Cross-Section Disengaged

Exploded View of Hydraulically Actuated Pin System for Dynamic Cam Lobe Fixturing - Normally Engaged Schematic of Hydraulically Actuated Pin System for Dynamic Cam Lobe Fixturing
Normally Engaged in Engaged Position Schematic of Hydraulically Actuated Pin System for Dynamic Cam Lobe Fixturing
Normally Engaged in Disengaged Position Exploded View of Hydraulically Actuated Pin System for Dynamic Cam Lobe Fixturing – Normally Disengaged Schematic of Hydraulically Actuated Pin System for Dynamic Cam Lobe Fixturing
Normally Disengaged in Disengaged Position Schematic of Hydraulically Actuated Pin System for Dynamic Cam Lobe Fixturing
Normally Disengaged in Engaged Position

APPARATUS AND METHOD FOR DYNAMIC HYDRAULIC LOCKING AND RELEASING A CAM LOBE FROM A CAMSHAFT

FIELD OF THE INVENTION

This invention relates to an internal combustion engine using a camshaft to actuate poppet type valves to direct gases into and out of one or more cylinders.

BACKGROUND

A description of a system to allow non-dynamic phasing of cam lobes is given by Goracy in U.S. Pat. No. 7,036,473 B1, which is hereby incorporated by reference for all that is taught and disclosed therein.

Numerous inventors have patented dynamic systems of valve actuation, focusing either on the rocker arm (e.g. Honda, U.S. Pat. No. 4,788,946, Porsche, U.S. Pat. No. 5,603,293) or on the lifter (GM, U.S. Pat. Nos. 6,557,518, 7,503,296). U.S. Pat. No. 4,788,946, the inventors describe a means of locking components of multiple piece rocker arms together to allow operation of specific cam lobes (low lift, low duration, or high lift, high duration) on a single valve. In the case of U.S. Pat. No. 7,503,296 the inventors show a collapsing follower that may be made rigid dynamically, allowing actuation of the connected valve when desired, or allowing the valve to remain closed when desired.

SUMMARY

An embodiment of the invention may therefore comprise a dynamically locking cam lobe engagement system, the system comprising a camshaft, the camshaft comprising a first key slot and a second key slot, a cam lobe comprising a channel through the cam lobe and wherein the cam lobe fits over the camshaft and between the first key slot and the second key slot, a first moveable disk comprising a pin extension which engages the channel, wherein the first moveable disk fits over the camshaft, the first moveable disk comprises a slot on an interior portion of the first moveable disk engages a first key in one of the first and second key slots, a first axial movement limitation ring fitted onto the camshaft in a position to limit movement of the first moveable disk in a direction away from the cam lobe, a second moveable disk comprising a second pin extension which engages the channel, wherein the second moveable disk fits over the camshaft, the second moveable disk comprises a slot on an interior portion of the second moveable disk which engages a second key in one of the first and second key slots, a second axial movement limitation ring fitted onto the camshaft in a position to limit movement of the second moveable disk in a direction away from the cam lobe.

An embodiment of the invention may further comprise a dynamic cam lobe fixturing system, the system comprising a camshaft, a cam lobe comprising a cam lobe channel through the cam lobe and wherein the cam lobe fits over the camshaft, a first fixed disk pressed onto the camshaft on a first side of the cam lobe which rotates with the camshaft, the first disk comprising at least one first disk channel, a second fixed disk pressed onto the camshaft on a second side of the cam lobe which rotates with the camshaft, the second disk comprising at least one second disk channel, a first pinned disk which fits over the camshaft comprising at least one first disk pin wherein the at least one first disk pin is aligned with the at least one first disk channel of the first fixed disk and wherein the first pinned disk engages the cam lobe channel with the at least one first disk pin, resulting in a predetermined angular relationship between the cam lobe and the camshaft, a second pinned disk which fits over the camshaft on a side of the cam lobe opposite the first pinned disk, the second pinned disk comprising at least one second disk pin wherein the at least one second disk pin is aligned with the at least one second disk channel of the second fixed disk and wherein the first pinned disk engages the cam lobe channel with one of the at least one second disk pin, resulting in a predetermined angular relationship between the cam lobe and the camshaft, a first axial movement limitation ring fitted onto the camshaft in a position to limit movement of the first pinned disk in a direction away from the cam lobe, a second axial movement limitation ring fitted onto the camshaft in a position to limit movement of the second pinned disk in a direction away from the cam lobe.

An embodiment of the invention may further comprise an hydraulically actuated pin system for dynamic cam lobe fixturing, the system comprising a camshaft comprising a first channel, a first collar pressed onto the camshaft wherein the first collar rotates with the camshaft and the first collar comprises a second channel wherein the second channel is selectively engages with the first channel in the camshaft, a second collar pressed onto the camshaft wherein the second collar rotates with the camshaft, the second collar comprising a third channel wherein the third channel has a same axial alignment as the second channel, a cam lobe rotatably mounted on the camshaft and which is axially constrained by the first and second collars, the cam lobe comprising a fourth channel, wherein the second channel and the third channel have a same axial alignment as the fourth channel, a first pin which is engages with both the second channel of the first collar and the fourth channel of the cam lobe, wherein when the first pin engages both the second channel and the fourth channel simultaneously, the cam lobe is locked in position with the first collar, a second pin which engages with both the fourth channel of the cam lobe and the third channel of the second collar, wherein the second pin interacts with the first pin to move in and out of the fourth channel of the cam lobe, a spring placed inside the third channel of the second collar enabled to push the second pin toward the fourth channel in the cam lobe when a force exerted by a hydraulic pressure in the first channel and the second channel is less than a force exerted by the spring.

An embodiment of the invention may further comprise a method of dynamically locking and unlocking a cam lobe, the method comprising placing a cam lobe over a camshaft, the cam lobe comprising at least one first channel, placing a first disk and a second disk over the camshaft, wherein the first disk is on a first side of the cam lobe and the second disk is on a second side of the cam lobe, the first disk comprising at least one first pin and the second disk comprising at least one second pin, placing an axial limitation on the camshaft to limit axial movement of the first disk and the second disk away from the cam lobe, moving the first disk and the second disk axially over the camshaft toward the cam lobe to engage the at least one first pin on the first disk and the at least one second pin on the second disk with the at least one the first channel of the cam lobe, moving the first disk and the second disk axially over the camshaft away from the cam lobe to disengage from the at least one first pin on the first disk and the at least one second pin on the second disk with the at least one first channel of the cam lobe.

An embodiment of the invention may further comprise a method of hydraulically actuating and de-actuating a pin system for dynamic cam lobe fixturing, the method comprising pressing a first collar onto a camshaft, the camshaft comprising a first channel and the first collar comprising a second channel, aligning the first channel with the second channel, placing a cam lobe on the camshaft, wherein the cam lobe is rotatably placed on the camshaft and the cam lobe comprises a third channel, pressing a second collar onto the camshaft, the second collar comprising a cavity, placing a first pin intermediate between the third channel of the cam lobe and the second channel of the first collar, placing a spring in the cavity, placing a second pin intermediate between the third channel of the cam lobe and the cavity of the second collar, hydraulically pressurizing the first pin via the first channel and the second channel to cause the first pin to move entirely into the third channel of the cam lobe and to push the second pin entirely into the cavity of the second collar, reducing hydraulic pressure in the first channel to allow the first pin to allow the spring to push the second pin to an intermediate position between the cam lobe and the second collar and push the first pin to an intermediate position between the cam lobe and the second collar.

DETAILED DESCRIPTION

The present invention describes a simple system for allowing dynamic engagement or disengagement via hydraulic means of a cam lobe on the camshaft. Embodiments of the invention may require some or all of the following:

- An alignment between camshaft and cam lobe to engage the cam lobe at a specified angular relationship with the camshaft.
- An apparatus and method to "park" the cam lobe when disengaged so that it is not rotating. Preferably at an angle that allows some rotation of the cam lobe as engagement occurs prior to contact with the follower/roller.
- Synchronization of the disengagement of the cam lobe from the camshaft with an arresting mechanism for preventing the rotation of the cam lobe.
- Synchronization of the removal of the arresting mechanism simultaneous with the engagement of the cam lobe with the camshaft.
- Means to use aligned cavities in both the cam lobe and one or more features fixed to the camshaft so that pins may be engaged or disengaged by a combination of pins and an oil supply controlled by a solenoid system. The pins and cavities may be cylindrical in shape, or any other suitable shape so long as they mate with minimal clearance. The pins should have chamfered leading edges to facilitate engagement.
- Such an oil supply might be introduced through the camshaft and enter the camshaft feature with suitable drillings or other cavities.
- A sandwich feature is required on the camshaft to ensure the lobe does not move substantially axially when the activation or spring force is applied to engage or disengage.
- Cam lobe may require a locking device for appropriate orientation when disengaged to allow maximum, or near maximum rotation angle for secure engagement to occur prior to valve actuation.
- Return springs to provide the opposite force requirement. This system may be engaged by default (not activated) and disengaged when the activation force is applied, or vice versa.
- System may be activated or deactivated on a cycle-by-cycle basis, so that it may have n cycles on, and m cycles off, where n and m are integers greater or equal to 0.

Figure 1:
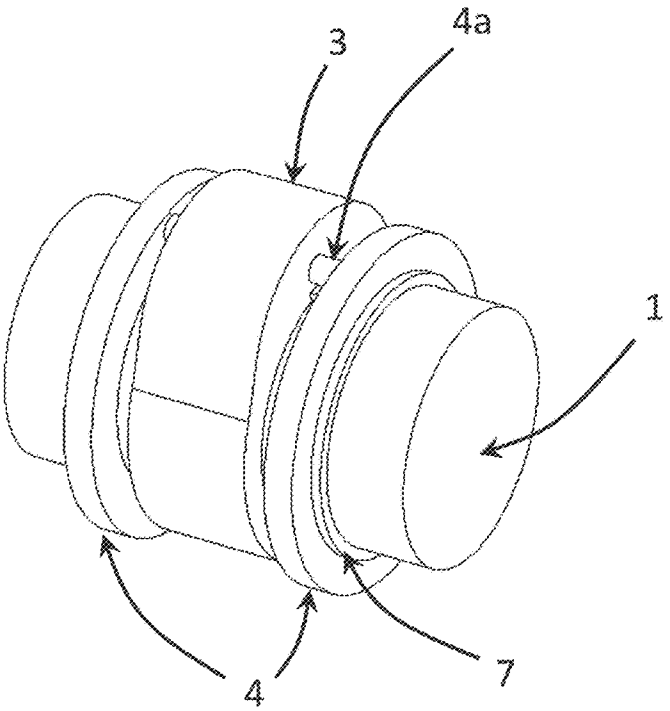
FIG. 1 shows a cross-sectional view of a dynamically actuatable cam lobe system with the cam lobe in a normally engaged position.

FIG. 1 shows an embodiment of an assembled view of a dynamically actuatable cam lobe system. Ring 7 is fixed to camshaft 1, limiting axial movement of movable disks 4. Pin 4*a* is shown retracted from rotatable cam lobe 3.

Figure 2:
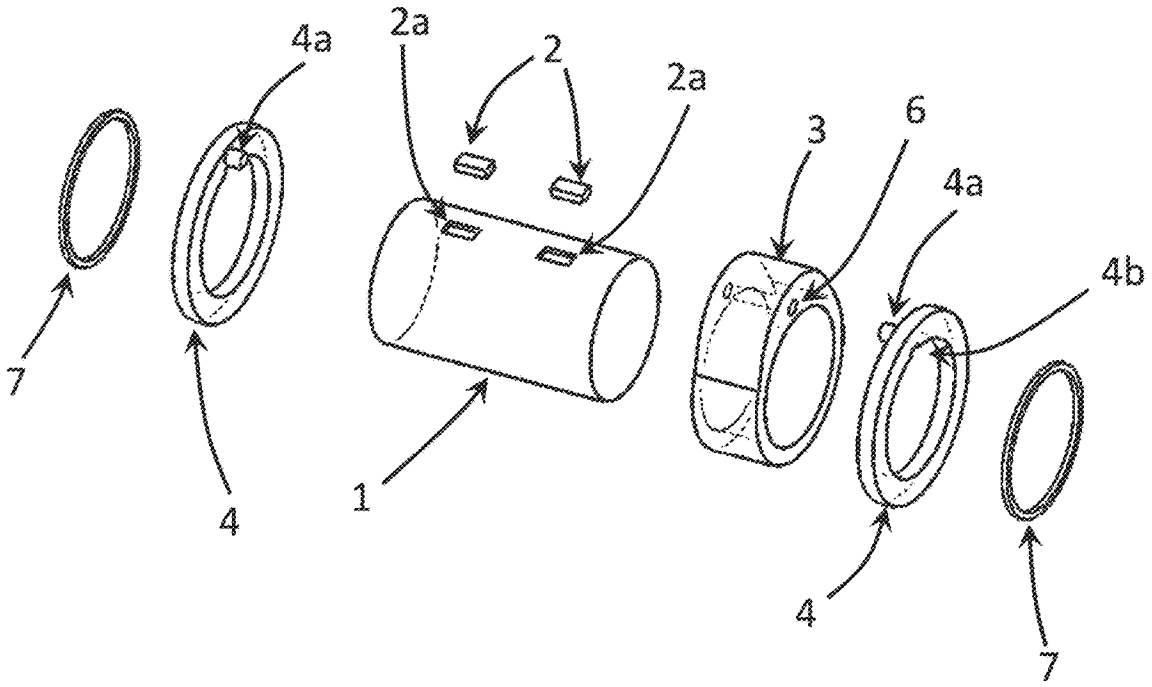
FIG. 2 shows pins actuated by hydraulic oil

FIG. 2 shows an exploded view of the components of FIG. 1. Camshaft 1 has two key slots 2*a* into which keys 2 are located. Moveable disks 4, with keyways 4*b* are axially slidable over keys 2 on camshaft 1 while maintaining a fixed rotational relationship to each other. Cam lobe 3 can slide over camshaft 1 with minimal clearance thus enabling cam lobe 3 to rotate independently of camshaft 1. Keys 2, in key slots 2*a*, act to constrain any axial movement of cam lobe 3 with a small axial clearance. Keys 2 may also be alternatively referred to as collars 2. Pins 4*a* on moveable disks 4 may engage with cavity 6 on cam lobe 3 to lock cam lobe 3 to camshaft 1. Rings 7 are pressed onto camshaft 1 to limit axial movement of moveable disks 4 when moveable disks 4 have been moved outward so that pins 4*a* retract from cavity 6 in cam lobe 3.

Figure 3:
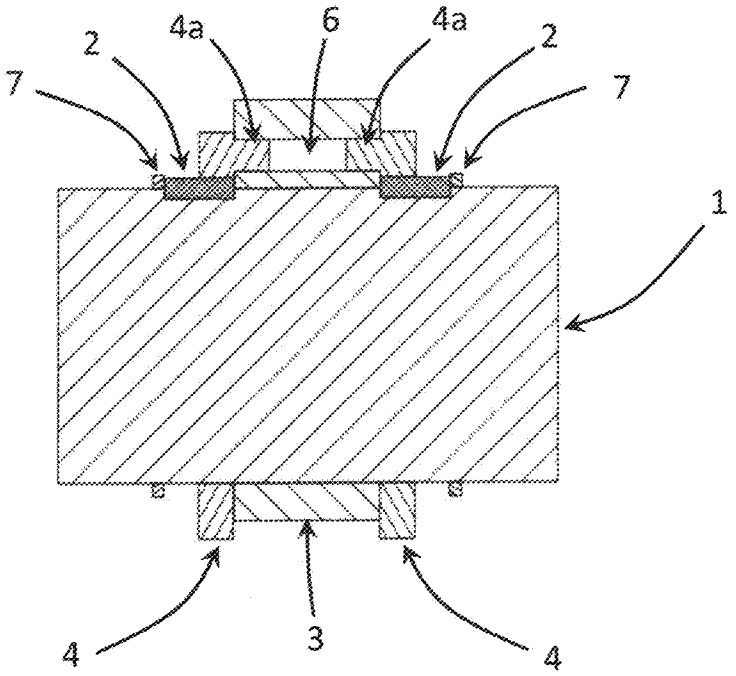
FIG. 3 shows a cross-sectional view of a dynamically actuatable cam lobe system with the cam lobe in a normally engaged position.

FIG. 3 shows a cross-sectional view of a dynamically actuatable cam lobe system with the cam lobe in a normally engaged position. The cam lobe 3 thus acts as a conventional cam lobe on a camshaft. Collars 2 are fixed to camshaft 1 and have shoulders against which cam lobe 3 is constrained axially. Cam lobe 3 may touch, but with sufficient clearance to allow unhindered rotation when cam lobe 3 is not locked to camshaft 1. Cam lobe 3 may be held stationary while camshaft 1 rotates, although such a retention system is not shown. Pins 4*a* engage cam lobe 3 with collars 2 to lock cam lobe 3 to camshaft 1. Hydraulic fluid may be delivered via a channel 24 (shown in FIG. 11) in camshaft 1, and may actuate pins 4*a* against ring 7. Pins 4*a* have chamfered edges where they engage/disengage with collars 2 and cam lobe 3.

In embodiments of the invention, one or more cam lobes may be dynamically engaged or disengaged as desired during rotation of the camshaft to allow timed operation of the valve(s) associated with the particular cam lobe with engine rotation or complete deactivation of the valve(s) associated with that particular cam lobe.

Figure 4:
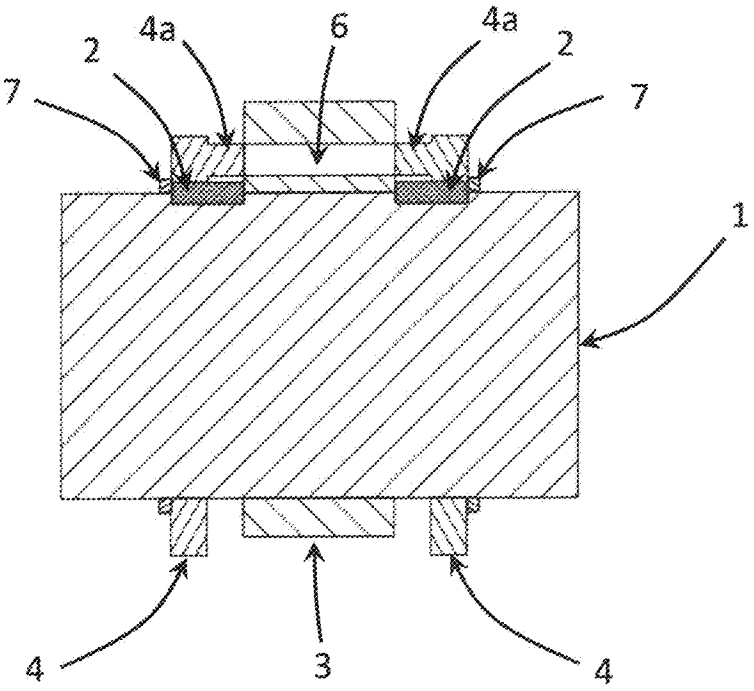
FIG. 4 shows pins actuated by hydraulic oil.

FIG. 4 shows pins 4*a* actuated by hydraulic oil, ring 7, disengaging cam lobe 3 from collars 2, and thus camshaft 1, allowing the camshaft to rotate while the cam lobe remains stationary (via a retention system not shown.) Vent hole 28 (shown in FIG. 14) allows any oil accumulated in the recess for the spring to escape, ensuring that pins 4*a* may move freely. When pin 4*a* is actuated it seats within collar 2 and its length is such that the boundary between pin 4*a* on one side of the cam lobe 3 and pin 4*a* on the other side of a lobe 3 coincides with the edge of collar 2 adjacent to cam lobe 3, allowing unhindered rotation of camshaft 1 and collars 2 while cam lobe 3 is stationary.

A discussed, FIG. 4 shows a cross-sectional view of a dynamically actuatable cam lobe system with the cam lobe in a normally disengaged position. Collars 2 are fixed to camshaft 1 and have shoulders against which cam lobe 3 is constrained axially and may touch, but with sufficient clearance to allow unhindered rotation when cam lobe 3 is not locked to camshaft 1. Cam lobe 3 may be held stationary while camshaft 1 rotates, although such a retention system is not shown. Pins 4*a* engage cam lobe 3 with collars 2 to lock cam lobe 3 to camshaft 1. Hydraulic fluid may be delivered via channel 24 (shown in FIG. 11) in camshaft 1, and may actuate pins 4*a* against ring 7. Pins 4*a* have chamfered edges where they engage/disengage with collars 2 and cam 3.

Figure 5:
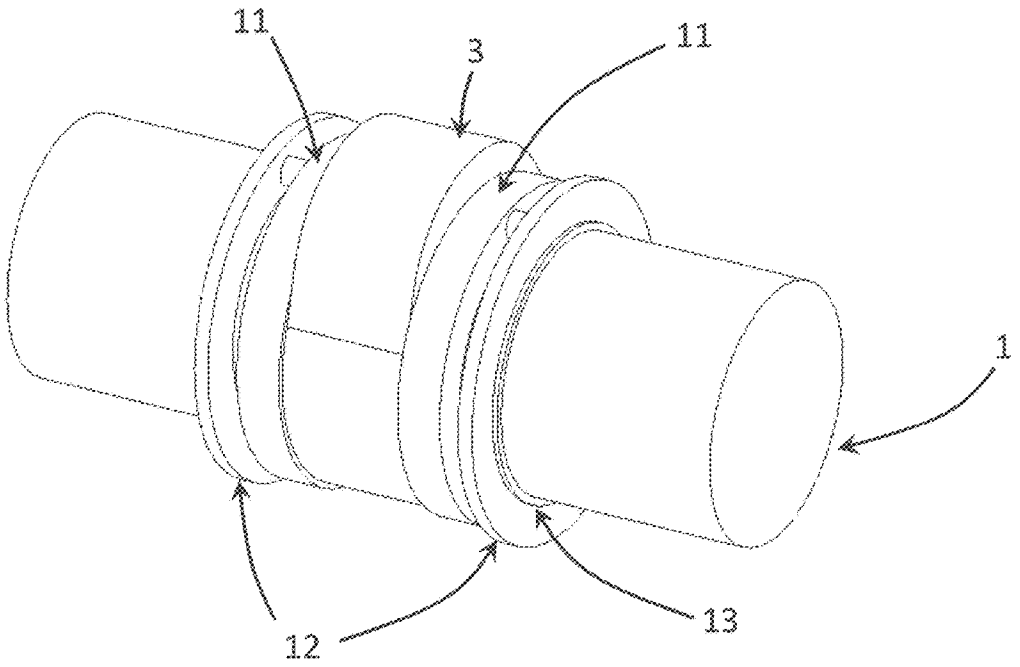
FIG. 5 shows an assembled view of a second embodiment of a dynamically actuatable cam lobe system.

FIG. 5 shows an assembled view of a second embodiment of a dynamically actuatable cam lobe system. In this view disk 13 is fixed to camshaft 1, limiting axial movement of movable disks 12. Disks 11 are pressed onto camshaft 1 and rotate with camshaft 1.

Figure 6:
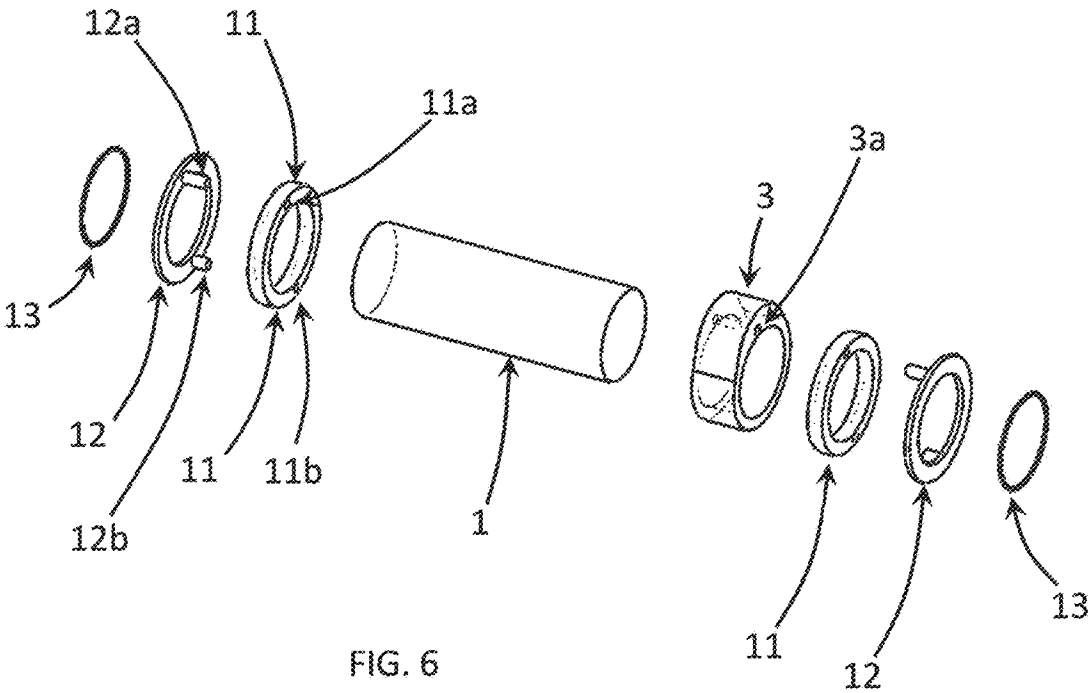
FIG. 6 shows an exploded view of the components dynamically actuatable cam lobe system

FIG. 6 shows an exploded view of the components in FIG. 5. Disks 11, which is fixed to camshaft 1, has cavities 11*a* and 11*b* into which pins 12*a* and 12*b* respectively on disk 12 may fit with close tolerances. Disks 12 slide over camshaft 1 with a small clearance, while rings 13 ensure that the axial movement of disks 12 is such that pins 12*a* and 12*b* are in permanent engagement with disks 11. Thus disks 12 rotate with camshaft 1 at all times. When moved to their innermost positions, pins 12*a* may engage with cavity 3*a* in cam lobe 3, locking cam lobe 3 to camshaft 1.

Figure 7:
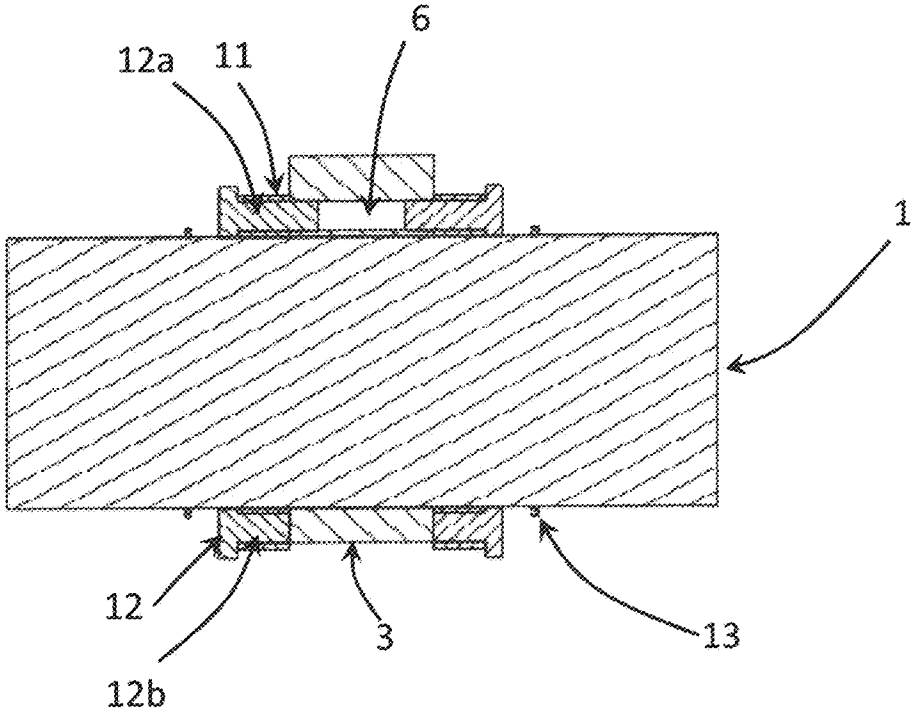
FIG. 7 shows a cross-sectional view of the components of a dynamically actuatable cam lobe system with the cam lobe in a normally engaged position

FIG. 7 shows a cross-sectional view of the components in FIG. 5 and FIG. 6 with the cam lobe in a normally engaged position, thus acting as a conventional cam lobe on a camshaft. Collars 11 are fixed to camshaft 1 and have shoulders against which cam lobe 3 is constrained axially and may touch, but with sufficient clearance to allow unhindered rotation when cam lobe 3 is not locked to camshaft 1. Cam lobe 3 may be held stationary while camshaft 1 rotates, although such a retention system is not shown. Collars 11 have through holes 11*a* and 11*b* through which pass pins 12*a* and 12*b* attached to disks 12. The primary purpose of pins 12*a* is to lock cam lobe 3 to collars 11, locking cam lobe 3 to camshaft 1. The secondary purpose of pins 12*a* and 12*b* is to ensure that disks 12 are oriented parallel to collars 11, facilitating axial motion of disks 12 without binding.

Figure 8:
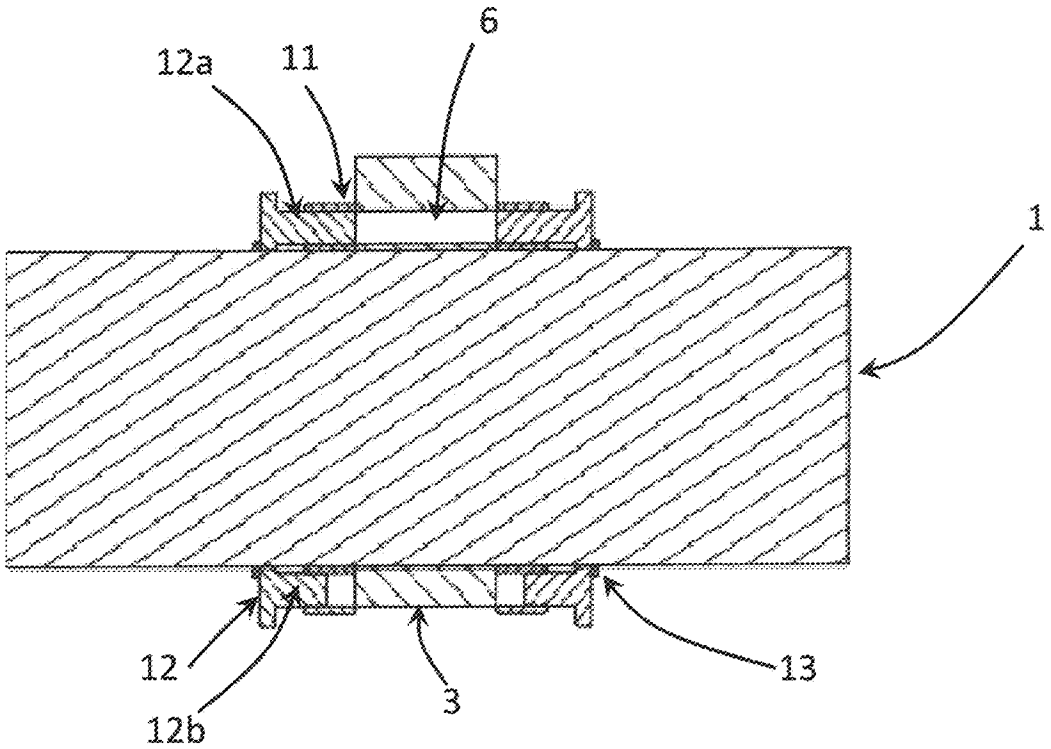
FIG. 8 shows a cross-sectional view of the components of a dynamically actuatable cam lobe system with disks moved.

FIG. 8 shows the same components as FIG. 7, with disks 12 moved outwards so that pins 12*a* are disengaged from cam lobe 3, disengaging cam lobe 3 from camshaft 1. Collars 13 are pressed onto camshaft 1 to limit the axial travel of disks 12 while still ensuring that pins 12*a* and 12*b* remain located in collars 11, thus ensuring that disks 12 rotate with disks 11, and thus camshaft 1.

Figure 9:
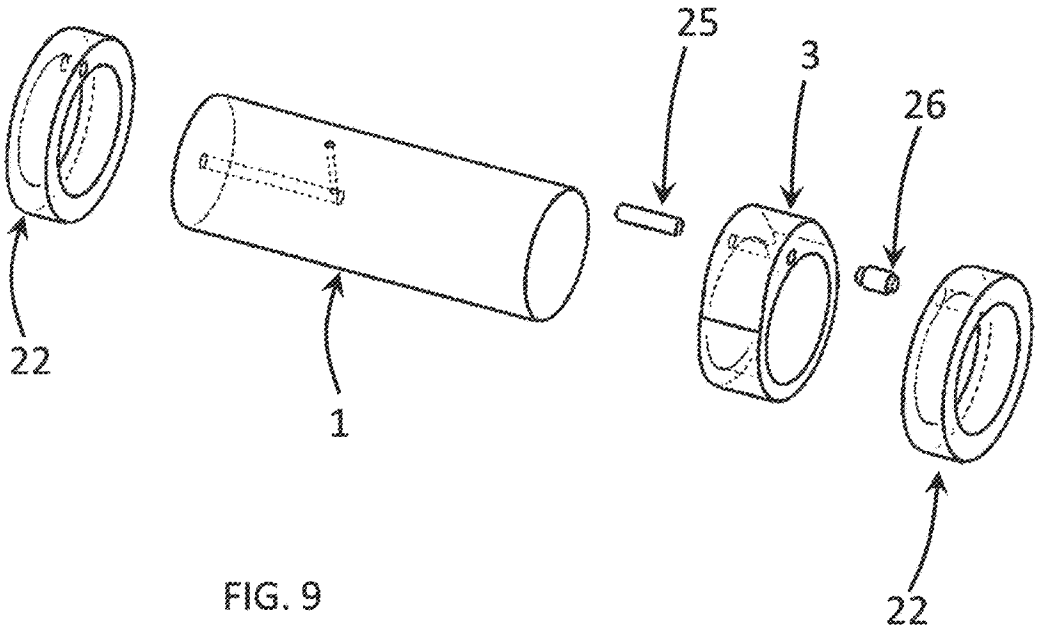
FIG. 9 shows an exploded view of an embodiment of a dynamically actuatable cam lobe system with the cam lobe in a normally engaged position.

FIG. 9 shows an exploded view of a third embodiment of a dynamically actuatable cam lobe system with the cam lobe in a normally engaged position, thus acting as a conventional cam lobe on a camshaft. Collars 22 are pressed onto camshaft 1, and thus rotate with camshaft 1. Cam lobe 3 slides onto camshaft 1 with minimal radial clearance, and is constrained axially by collars 22 with minimal axial clearance. Pins 25 and 26 act to lock cam lobe 3 with collars 22, and thus camshaft 1.

Figure 10:
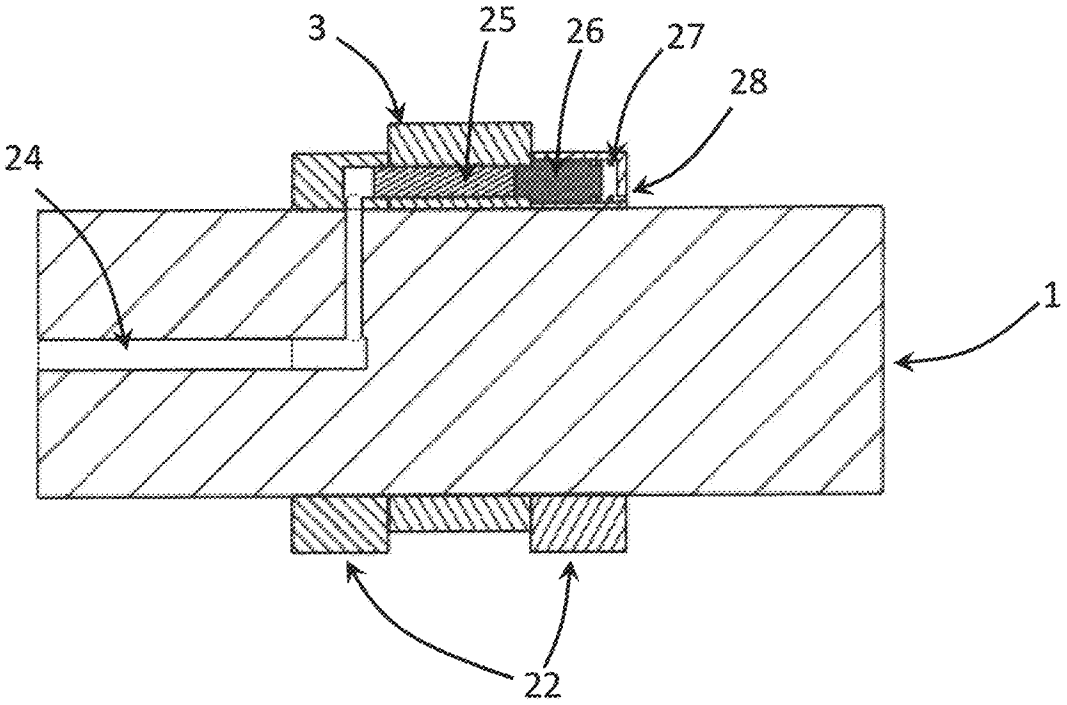
FIG. 10 shows a cross-sectional view of an embodiment of a dynamically actuatable cam lobe system with the cam lobe in a normally engaged position.

FIG. 10 shows a cross-sectional view of the components in FIG. 9. Collars 22 are fixed to camshaft 1 and have shoulders against which cam lobe 3 is constrained axially and may touch, but with sufficient clearance to allow unhindered rotation when cam lobe 3 is not locked to camshaft 1. Cam lobe 3 may be held stationary while camshaft 1 rotates, although such a retention system is not shown. Pins 25 and 26 engage cam lobe 3 with collars 22 to lock cam lobe 3 to camshaft 1. Hydraulic fluid may be delivered via channel 24 in camshaft 1, and may actuate pins 25 and 26 against spring 27. Pins 25 and 26 have chamfered edges where they engage/disengage with collars 22 and cam lobe 3.

Figure 11:
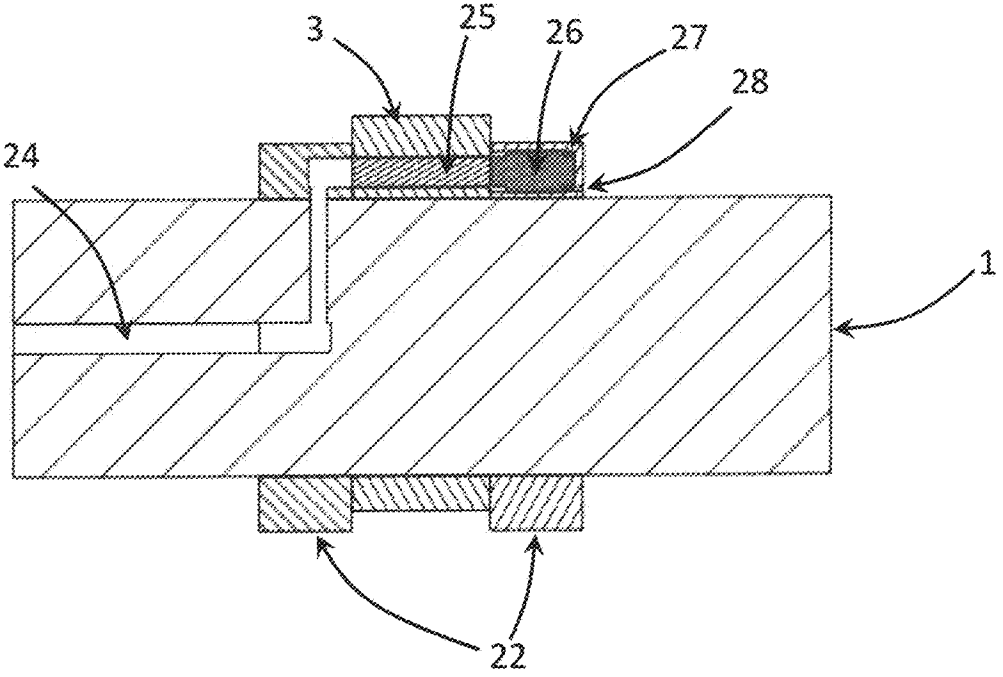
FIG. 11 shows a cross-sectional view of an embodiment of a dynamically actuatable cam lobe system with pins actuated by hydraulic oil

FIG. 11 shows the same components as in FIG. 10, with pins 25 and 26 actuated by hydraulic oil, compressing spring 27, and disengaging cam lobe 3 from collars 22, and thus camshaft 1, allowing the camshaft to rotate while the cam lobe remains stationary (via a retention system not shown.) Vent hole 28 allows any oil accumulated in the recess for the spring to escape, ensuring that pins 25 and 26 may move freely. When pin 26 is actuated it seats within collar 22 and its length is such that the boundary between pin 25 and pin 26 coincides with the edge of collar 22 adjacent to cam lobe 3, allowing unhindered rotation of cam 1 and collars 22 while cam lobe 3 is stationary.

Figure 12:
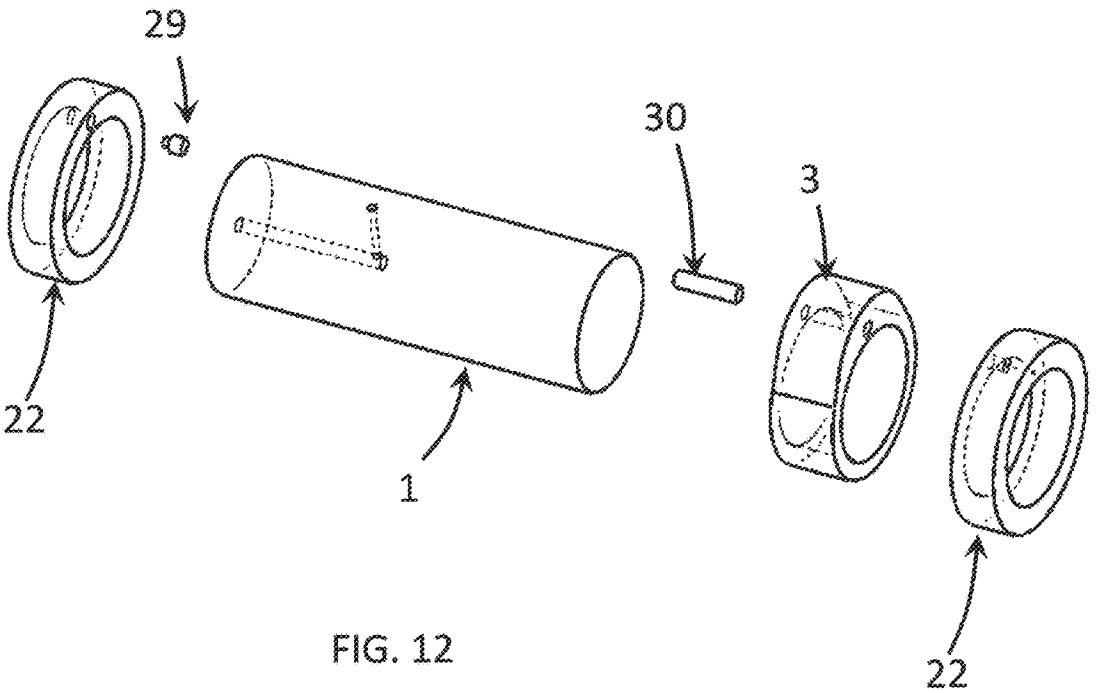
FIG. 12 shows an exploded view of an embodiment of a dynamically actuatable cam lobe system with the cam lobe in a normally disengaged position

FIG. 12 shows an exploded view of a fourth embodiment of a dynamically actuatable cam lobe system with the cam lobe in a normally disengaged position, thus preventing the cam lobe rotating with the camshaft. Collars 22 are pressed onto camshaft 1, and thus rotate with camshaft 1. Cam lobe 3 slides onto camshaft 1 with minimal radial clearance, and is constrained axially by collars 22 with minimal axial clearance. Pins 29 and 30 act to unlock or lock cam lobe 3 to collars 22, and thus camshaft 1.

Figure 13:
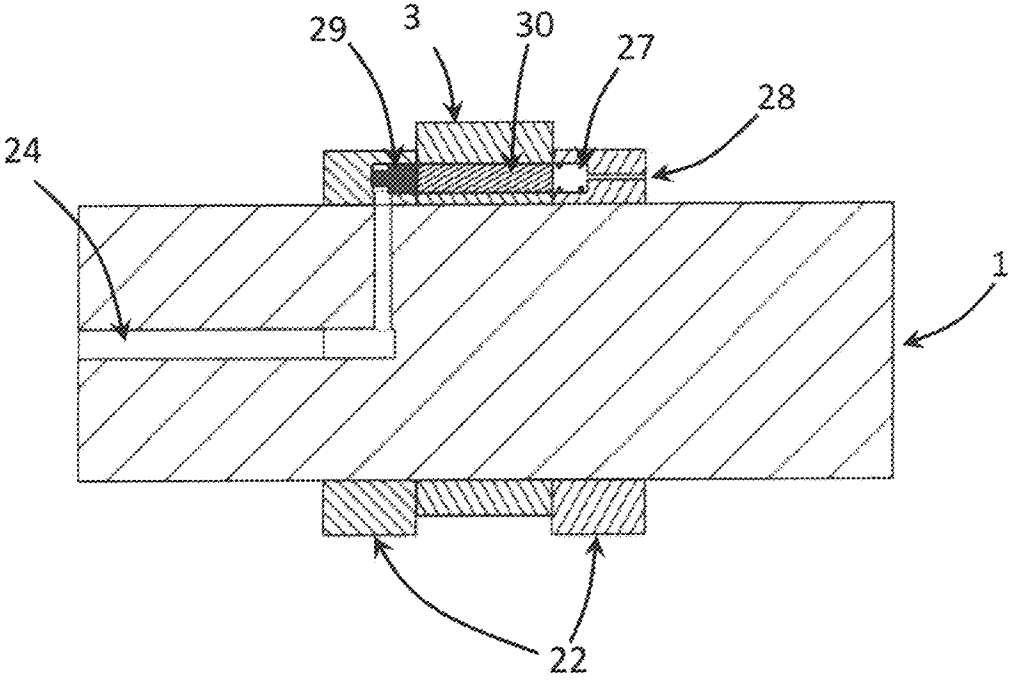
FIG. 13 shows a cross-sectional view of a dynamically actuatable cam lobe system with the cam lobe in a normally disengaged position.

FIG. 13 shows a cross-sectional view of the components in FIG. 12 with the cam lobe in a normally disengaged position. Collars 22 are fixed to camshaft 1 and have shoulders against which cam lobe 3 is constrained axially and may touch, but with sufficient clearance to allow unhindered rotation when cam lobe 3 is not locked to camshaft 1. Cam lobe 3 may be held stationary while camshaft 1 rotates, although such a retention system is not shown. Pins 29 and 30 engage cam lobe 3 with collars 22 to lock cam lobe 3 to camshaft 1. Hydraulic fluid may be delivered via channel 24 in camshaft 1, and may actuate pins 29 and 30 against spring 27. Pins 29 and 30 have chamfered edges where they engage/disengage with collars 22 and cam 3.

Figure 14:
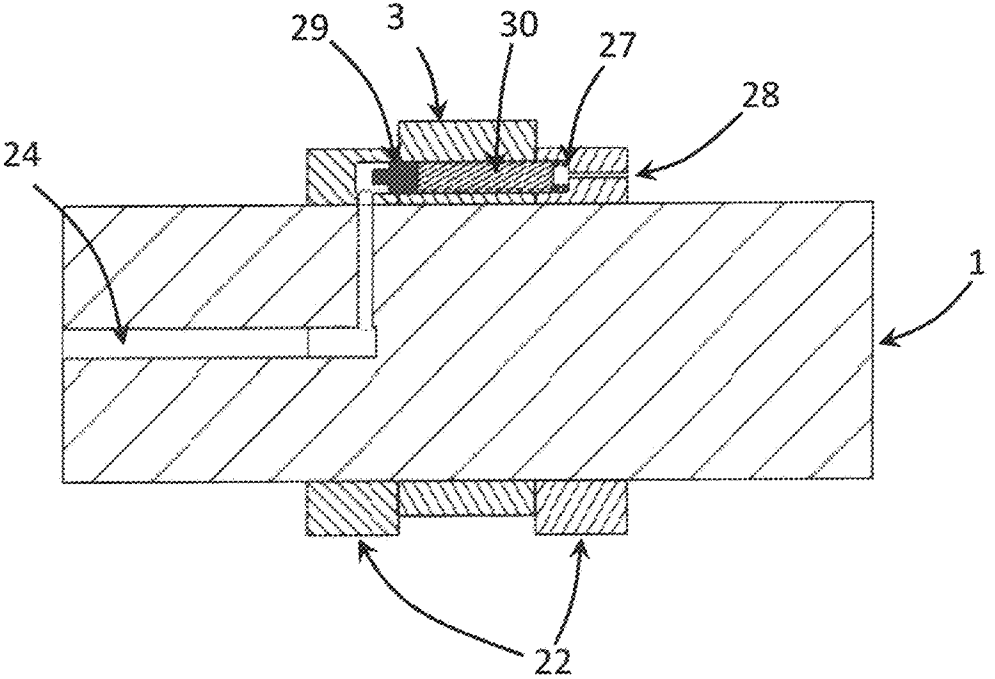
FIG. 14 shows a cross-sectional view of a dynamically actuatable cam lobe with pins actuated by hydraulic oil.

FIG. 14 shows the same components as in FIG. 13 with pins 29 and 30 actuated by hydraulic oil, compressing spring 27, and engaging cam lobe 3 with collars 22, and thus camshaft 1, allowing the cam lobe to rotate synchronously with camshaft 1. Vent hole 28 allows any oil accumulated in the recess for the spring to escape, ensuring that pins 29 and 30 may move freely.

Embodiments of the invention may also comprise a non-rigid retention mechanism that holds the non-rotating cam lobe 3 at a preferential angle while camshaft 1 rotates. Such a mechanism may be flexible enough that re-engagement of cam lobe 3 with camshaft 1 would allow essentially unhindered rotation of cam lobe 3 synchronously with camshaft 1.

What is claimed is:

1. A dynamically locking cam lobe engagement system, said system comprising:

a camshaft, said camshaft comprising a first key slot and a second key slot;

a cam lobe comprising a channel through said cam lobe and wherein said cam lobe fits over said camshaft and between said first key slot and said second key slot;

a first moveable disk comprising a first pin extension which engages said channel, wherein said first moveable disk fits over said camshaft, said first moveable disk comprises a slot on an interior portion of said first moveable disk which engages a first key in one of said first and second key slots;

a first axial movement limitation ring fitted onto said camshaft in a position to limit movement of said first moveable disk in a direction away from said cam lobe;

a second moveable disk comprising a second pin extension which engages said channel, wherein said second moveable disk fits over said camshaft, said second moveable disk comprises a slot on an interior portion of said second moveable disk which engages a second key in one of said first and second key slots;

a second axial movement limitation ring fitted onto said camshaft in a position to limit movement of said second moveable disk in a direction away from said cam lobe.

2. The dynamically locking cam lobe engagement system of claim 1, wherein said first and second moveable disks move axially about said camshaft toward and away from said cam lobe and wherein said first and second in extensions of said first and second moveable disks engage said channel when said first and second moveable disks move toward said cam lobe.

3. A dynamic cam lobe fixturing system, said system comprising:

a camshaft;

a cam lobe comprising a cam lobe channel through said cam lobe and wherein said cam lobe fits over said camshaft;

a first fixed disk pressed onto said camshaft on a first side of said cam lobe which rotates with said camshaft, said first disk comprising at least one first disk channel;

a second fixed disk pressed onto said camshaft on a second side of said cam lobe which rotates with said camshaft, said second disk comprising at least one second disk channel;

a first pinned disk which fits over said camshaft comprising at least one first disk pin wherein said at least one first disk pin is aligned with said at least one first disk channel of said first fixed disk and wherein said first pinned disk engages said cam lobe channel with said at least one first disk pin, resulting in a predetermined angular relationship between said cam lobe and said camshaft;

a second pinned disk which fits over said camshaft on a side of said cam lobe opposite said first pinned disk, said second pinned disk comprising at least one second disk pin wherein said at least one second disk pin is aligned with said at least one second disk channel of said second fixed disk and wherein said first pinned disk engages said cam lobe channel with one of said at least one second disk pin, resulting in a predetermined angular relationship between said cam lobe and said camshaft;

a first axial movement limitation ring fitted onto said camshaft in a position to limit movement of said first pinned disk in a direction away from said cam lobe;

a second axial movement limitation ring fitted onto said camshaft in a position to limit movement of said second pinned disk in a direction away from said cam lobe.

4. A method of dynamically locking and unlocking a cam lobe, said method comprising:

placing a cam lobe over a camshaft, said cam lobe comprising at least one first channel;

placing a first disk and a second disk over said camshaft, wherein said first disk is on a first side of said cam lobe and said second disk is on a second side of said cam lobe, said first disk comprising at least one first pin and said second disk comprising at least one second pin;

placing an axial limitation on said camshaft to limit axial movement of said first disk and said second disk away from said cam lobe moving said first disk and said second disk axially over said camshaft toward said cam lobe to engage said at least one first pin on said first disk and at least one second pin on said second disk with the at least one first channel of said cam lobe;

moving said first disk and said second disk axially over said camshaft away from said cam lobe to disengage said at least one first pin on said first disk and said at least one second pin on said second disk with the at least one first channel of said cam lobe.

5. The method of claim 4, said method further comprising:

placing a first intermediate disk between said cam lobe and said first disk, said first intermediate disk comprising at least one second channel enabled to engage said at least one first pin of said first disk;

placing a second intermediate disk between said cam lobe and said second disk, said second intermediate disk comprising at least one third channel enabled to engage said at least one second pin of said second disk.

* * * * *